US006932457B2

(12) United States Patent
Sato

(10) Patent No.: US 6,932,457 B2
(45) Date of Patent: Aug. 23, 2005

(54) APPARATUS PROVIDED WITH CARRIAGE

(75) Inventor: Noriko Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 10/093,743

(22) Filed: Mar. 11, 2002

(65) Prior Publication Data

US 2002/0130923 A1 Sep. 19, 2002

(30) Foreign Application Priority Data

Mar. 15, 2001 (JP) ..... 2001-073657
Mar. 6, 2002 (JP) ..... 2002-059760

(51) Int. Cl.[7] ..... B41J 23/00
(52) U.S. Cl. ..... 347/37; 347/32; 400/352; 400/354
(58) Field of Search ..... 347/37, 32, 38, 347/39, 91; 400/352, 354, 354.3, 283; B41J 23/00, 2/18, 2/165

(56) References Cited

U.S. PATENT DOCUMENTS 4,227,219 A * 10/1980 Takemoto ..... 358/489
4,293,235 A * 10/1981 Gomi ..... 400/322
4,676,675 A * 6/1987 Suzuki et al. ..... 400/56
4,722,620 A * 2/1988 Igi et al. ..... 400/73
4,738,552 A * 4/1988 Kikuchi et al. ..... 400/59
4,832,517 A * 5/1989 Minaminaka ..... 400/185
5,074,688 A * 12/1991 Sato ..... 400/175
5,153,613 A * 10/1992 Yamaguchi et al. ..... 347/30
5,332,321 A * 7/1994 Beauchamp et al. ..... 400/354
5,366,305 A 11/1994 Christianson
5,506,606 A * 4/1996 Saikawa et al. ..... 346/134
5,517,218 A * 5/1996 Lehna et al. ..... 347/24
5,612,721 A * 3/1997 Ishize ..... 347/33
5,644,345 A * 7/1997 Toniolo ..... 347/32
5,903,287 A * 5/1999 Ishikawa et al. ..... 347/24
5,949,443 A * 9/1999 Yamamoto et al. ..... 347/3
5,975,778 A * 11/1999 Kanemitsu ..... 400/352
5,984,452 A * 11/1999 Bekki ..... 347/33
6,010,204 A * 1/2000 Morioka et al. ..... 347/37
6,024,434 A * 2/2000 Shimamura et al. ..... 347/32
6,059,396 A * 5/2000 Choi ..... 347/37
6,164,754 A * 12/2000 Ide et al. ..... 347/33
6,220,692 B1 * 4/2001 Iwaya et al. ..... 347/33
6,382,858 B1 * 5/2002 Nojima et al. ..... 400/691
6,386,681 B1 * 5/2002 Askren et al. ..... 347/49
6,443,552 B1 * 9/2002 Inoue et al. ..... 347/37
2002/0067941 A1 * 6/2002 Johnson et al. ..... 400/352

FOREIGN PATENT DOCUMENTS

EP 434327 A2 * 6/1991 ..... B41J/25/312
JP 05116338 A * 5/1993 ..... B41J/2/18
JP 7-19246 1/1995
JP 08090782 A * 4/1996 ..... B41J/2/165
JP 2001219568 A * 8/2001 ..... B41J/2/165

* cited by examiner

*Primary Examiner*—Manish Shah
*Assistant Examiner*—Leonard Liang
(74) *Attorney, Agent, or Firm*—Fitzpatrick, Cella, Harper & Scinto

(57) ABSTRACT

An apparatus provided with a carriage is guided and supported by at least two guide members, a guide shaft and a guide rail, arranged to be parallel to each other to enable the carriage to reciprocate. The guide members are arranged apart from each other substantially in the vertical direction, and the horizontal distance L1 between each guide member and the gravitational center of the carriage is arranged to be larger than the vertical interval L2 between the contact portions of the carriage and each guide member. With the structure thus arranged, it is possible to maximize the reduction of the swinging or vibration of a carriage so that the apparatus provided with the carriage can effect reciprocal scanning exactly and stably, thus realizing a small and high-performance apparatus that records images in high precision or reads highly precise images.

15 Claims, 6 Drawing Sheets

APPARATUS PROVIDED WITH CARRIAGE

BACKGROUND OF THE INVENTION

1. Field of the Invention

The present invention relates to an apparatus provided with a carriage. More particularly, the invention relates to the arrangement of a guide member when the carriage moves.

2. Related Background Art

Conventionally, it has been practiced for a recording apparatus, such as a printer or facsimile equipment, that records images on a recording sheet or some other recording medium in accordance with recording information or a reading apparatus that reads images from a source document, to mount a recording head or a reading head on a carriage capable of reciprocating along the guide member, such as a guide shaft, provided for the apparatus main body, and to perform recording or reading of information by driving the carriage to scan the surface of various kinds of media, such as a recording medium or a source document. Here, usually, two or more guide members (guide shafts or the like) guide and support a carriage to enable it to reciprocate.

The serial type recording apparatus serving as an apparatus provided with a carriage, which mounts a recording head that functions as recording means, performs reciprocal scanning for the execution of recording on a recording medium by driving the recording head to move in accordance with the recording signal and scanning, which are arranged to be in synchronism with each other. In recent years, along with more demand in obtaining images in higher precision, it is required for the scanning by use of a carriage to be more stable and executable at a speed made more constant then ever.

The carriage speed fluctuates often due to the fluctuation of rotational speed of a motor serving as the driving source, the eccentricity of gears or pulleys used for transmitting driving power, the backlash of toothed timing belt or gear used for transmission of the driving power, and the overshooting after the acceleration of the carriage, among some other driving means or driving transmitting means. Various studies are being made in order to reduce them.

On the other hand, not only by the speed fluctuation in the direction of the parallel advancement of the carriage, but also, by fine posture changes of the carriage (due to swinging or vibration), the recorded images may be disturbed in some cases.

Generally, the carriage is guided and supported in such a manner that a column (or cylindrical) guide shaft, having a slightly smaller diameter than the diameter of the circular hole of a bearing portion integrally arranged for the carriage, is penetrated through the hole thus arranged, and that the other portion of the carriage is allowed to abut against the guide rail arranged to extend substantially in parallel with the guide shaft. Also, in order to hold the carriage stably in the scanning direction, the bearing portion is arranged in plural locations apart from each other (usually in two locations) in the carriage scanning direction. At this juncture, the outer diameter of the guide shaft is made slightly smaller than the inner diameter of the bearing portion so that the carriage can slidably move smoothly along the guide shaft through the bearing portions arranged in plural locations. As a result, there exists a slight clearance (play) between the guide shaft and the bearing portion.

In this respect, it is desirable to provide driving means for the one of two guide members (the aforesaid guide shaft and guide rail), which has a larger sliding load. Usually, therefore, the carriage driving motor is connected near the bearing portion to be able to transmit the driving power.

During scanning of the carriage, should there exist obstacles, such as scratches or dust particles, on the guide rail, for example, the carriage slows down due to resistance on the sliding portion of the rail, and moment occurs on the bearing portion in the advancing direction. As a result, the carriage tends to rotate (or swing) in that direction. Then, the carriage rotates minutely due to the play between the outer circumferential surface of the guide shaft and the inner diameter of the bearing portion, and, further, the rotational motion in the opposite direction occurs due to repulsion exerted by the guide shaft. Consequently, a problem is encountered that the carriage vibrates.

Also, when the carriage begins scanning, the carriage accelerates by the addition of the driving power from driving means (the carriage motor). However, since the gravitational center of the carriage is usually placed near the central portion thereof so that it is away from the position near the bearing portion having the driving means connected therewith (the acting point of driving power), the carriage tends to rotate around the gravitational center instantaneously due to the inertia of its own. Such minute rotation (or swinging) as this also presents the problem that the carriage is caused to vibrate as described earlier.

In order to solve these problems, it is generally practiced to use the oil-immersed bronze member formed by sintered material for the bearing portion that fits with the guide shaft so as to enhance the precision of the bearing portion. However, for a structure such as this, the sintered material must be fixed to the carriage in good precision by the insert formation, bonding, or the like. Then, there is a problem that this arrangement leads to increasing costs. Also, with the installation of the bearing portion formed by sintered material, the carriage should be made larger to present a problem that the apparatus main body is made larger inevitably. Further, even with the adoption of a structure using sintered material, it is impossible to eliminate the play between the guide shaft and the bearing portion completely. Then, a problem is encountered that there is naturally a limit to the effect that may be produced on the reduction of vibration (or swinging) of the carriage in this way.

Meanwhile, there has been proposed in the specification of Japanese Patent Application Laid-Open No. 07-19246, a method for suppressing the swinging of the guide shaft inside the bearing portion with the provision of two flat surfaces above the bearing portion, each facing the guide shaft, respectively, to enable the guide shaft to be depressed to these two faces. In order to allow the two bearing flat surfaces that face the guide shaft to abut against it equally and stably by use of this method, the weight of the carriage itself should be large to a certain extent, and also, there is a need for arranging the guide rail to be away from the guide shaft as much as possible in the direction substantially perpendicular thereto.

A method of the kind, however, is inadequate for a serial type apparatus, such as a small recording apparatus for which the weight of carriage is made smaller, and the dimension in the height direction is also made smaller. There is a possibility that more vibration takes place during carriage scanning, and there remain technical problems yet to be solved.

SUMMARY OF THE INVENTION

In consideration of the problems of the conventional art discussed above, the present invention is designed. It is an object of the invention to provide an apparatus having a carriage capable of performing reciprocal scanning stably and exactly with extremely reduced swinging or vibration of the carriage so as to stably perform highly precise scanning required for various kinds of small, high-performance apparatuses, such as a recording apparatus that records highly precise images or reading apparatus for reading images formed in high-density and high-precision.

It is another object of the invention to provide an apparatus having a carriage for mounting a head member for reciprocation thereof, comprising plural guide members arranged in parallel to each other and away from each other substantially in the vertical direction for supporting and guiding the carriage to be reciprocally movable, and contact portions provided for the carriage to be in contact with each of the guide members, respectively, and for this carriage, the distance between the guide member and the gravitational center of the carriage in the horizontal direction is larger than the interval between the contact portions-themselves in the vertical direction.

DETAILED DESCRIPTION OF THE PREFERRED EMBODIMENTS

Hereinafter, with reference to the accompanying drawings, the description will be made of the embodiments specifically in accordance with the present invention. In this respect, the same reference marks designate the same parts or the corresponding parts throughout in each of the drawings.

Figure 5:
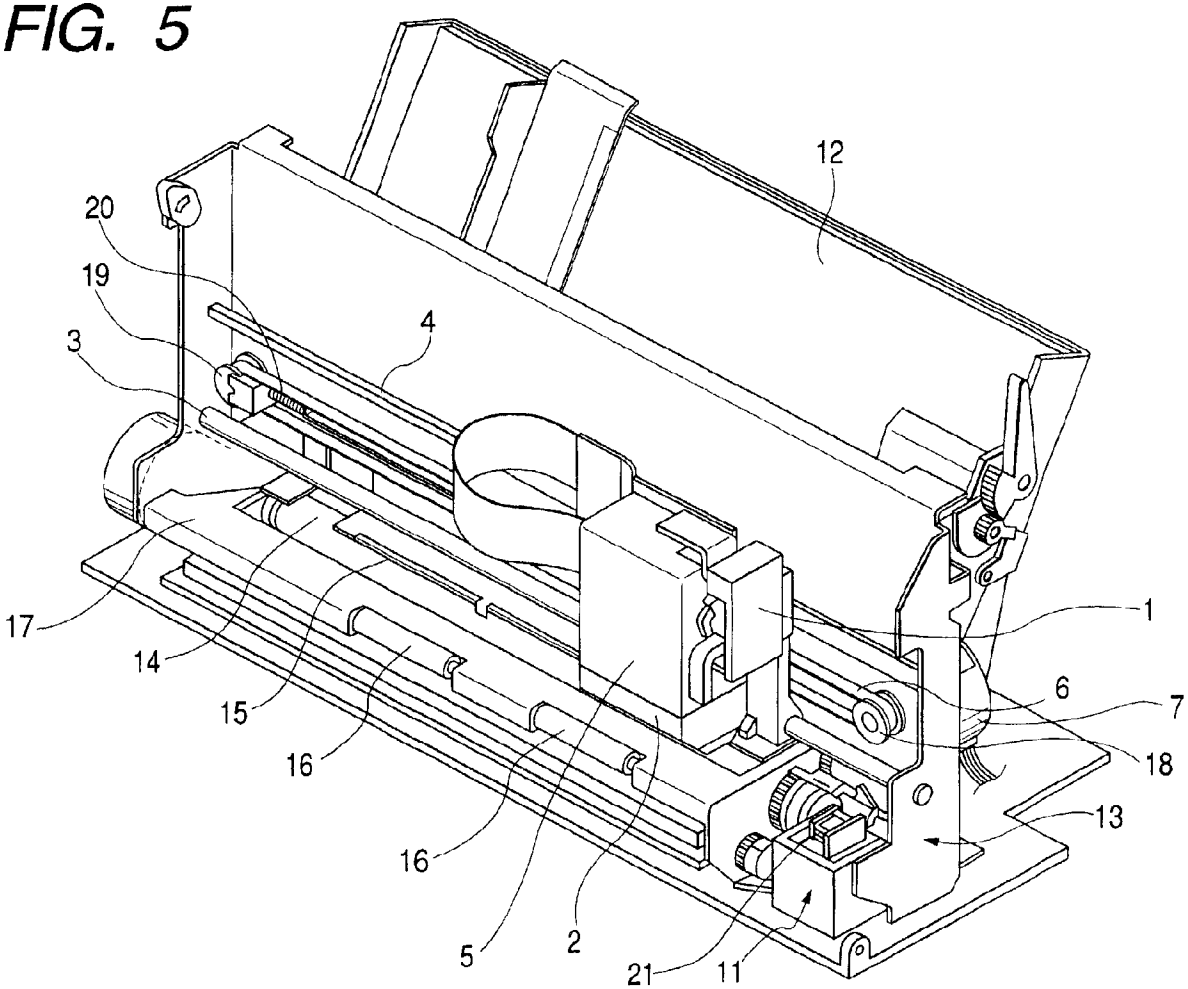
FIG. 5 is a partial perspective view that schematically shows the outline of the structure of a serial type recording apparatus exemplified as an apparatus provided with a carriage embodying the present invention.

FIG. 5 is a partial perspective view that schematically shows the outline of the structure of a serial type recording apparatus exemplified as an apparatus provided with a carriage embodying the present invention. Here, in FIG. 5, an ink jet recording apparatus is exemplified as the recording apparatus, but the apparatus may be the one having some other recording method as described later.

In FIG. 5, conveying means conveys a supplied recording medium (paper sheet, cloth, OHP sheet, or the like) for recording by use of recording means (recording head) 2 mounted on the carriage 1. For the present embodiment, the recording apparatus is of serial recording type, and the recording head 2 mounted on the carriage 1 reciprocates with respect to a recording medium for main scanning, and in synchronism therewith, the recording head 2 is driven in accordance with the image signal to discharge ink from the discharge ports for recording of one-line portion. With the completion of one-line portion recording, the recording medium is fed (sub-scanned) for a designated amount, and then, the recording operation is executed by the main scanning of the recording head to record next line. With the repetition of such recording operation and sheet feeding operation alternately, recording is made on the recording medium entirely.

Then, after recording, the recording medium is expelled to a designated outlet portion. Also, during the recording operation, the recording head 2 can be moved to the position that faces a recovery mechanism 11 at a designated timing as required for the execution of the recovery process for the recovery maintenance of the ink discharge performance of the recording head 2 by actuating recovery means of the recovery mechanism. As compared with the recording apparatus having another recording method, it is easier for the ink jet recording apparatus to form smaller dots and use many colors with a lesser amount of noise. Also, recording is possible without contact with a recording medium (recording sheet) to enable the conveyance of the recording medium in high precision. As a result, the ink jet recording apparatus is the one best suited for high-quality recording in colors.

The ink jet recording head 2 serving as recording means discharges ink utilizing thermal energy with the provision of an electrothermal converting element for generating thermal energy. Also, the recording head 2 generates film boiling in ink by the application of thermal energy by means of the electrothermal converting element, and by the utilization of pressure change exerted by the growth and shrinkage of a bubble generated at that time, ink is discharged from the discharge ports for recording.

Figure 6:
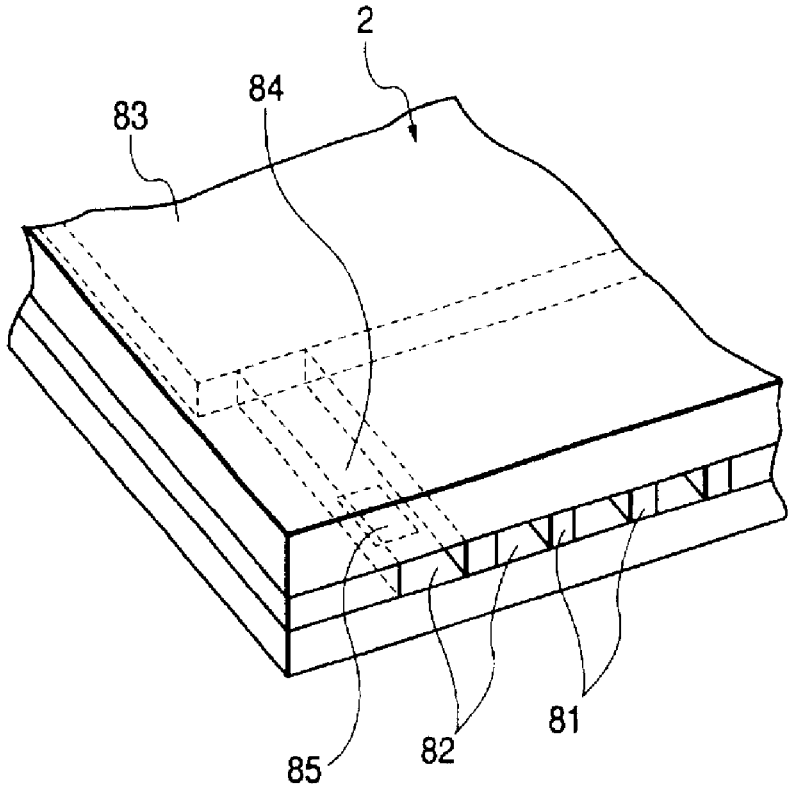
FIG. 6 is a partial perspective view that schematically shows the structure of the ink discharge portion of recording means represented in FIG. 1.

FIG. 6 is a partial perspective view that schematically shows the structure of the ink discharge portion of the ink jet recording head 2. In FIG. 6, plural discharge ports 82 are formed at designated pitches for the discharge port surface 81 that faces a paper sheet serving as a recording medium with a designated clearance (approximately 0.2 mm to 2.0 mm, for example), and the electrothermal converting element (heat generating resistive member, such as heater) 85, which generates energy for discharging ink, is arranged along the wall face of each liquid path 84 communicated with the common liquid chamber 83 and each discharge port 82. The recording head 2 is mounted on the carriage 1 in a positional relationship so that the discharge ports 82 are arranged in the direction intersecting with the main scanning direction (the direction in which the recording head and the carriage move). The recording means (recording head) 2 is structured in such a way that the corresponding electrothermal converting element 85 is driven (energized) in accordance with the image signal or discharge signal, thus creating film boiling in ink in the liquid path 84 to discharge ink from the discharge ports 82 by means of the pressure exerted at that time.

In FIG. 5, conveying means for conveying a recording medium (means for feeding sheet) conveys the recording medium supplied from the ASF (Automatic Sheet Feeder) 12 to the recording position, and after recording, expels the recording medium to the outlet portion.

In other words, plural sheets of the recording medium are set on the ASF 12 installed on the apparatus main body 13 at first. For the ASF 12, a separation mechanism (not shown) is provided to separate one by one sheets of recording medium from the stack of sheets set thereon, and supply (feed) the recording medium thus separated into the apparatus main body 13. The conveying roller 14 arranged for the recording portion (the position that faces the recording head 2, that is, the recording position) on the upstream side in the conveying direction, and the pinch roller 15 that contacts therewith to rotate pinch the recording medium thus fed, and convey the recording medium thereafter through the recording portion by the designated sheet feeding operation with the conveying force exerted by the conveying roller 14 driven to rotate.

As the conveying roller 14, there is the one with a rubber layer coated in a thickness of 1 mm or less on the cylindrical metal surface or the one having roughly finished surface, among some others in use. For the roller of coating type, there is also the one having ceramic particles or the like mixed in the coating layer in order to enhance the capability of conveying a recording medium.

Also, the recording medium after recording is expelled to the outlet portion by use of an expelling roller 16 and the spur serving as a rotational member that follows the rotation thereof. Further, among the conveying paths of a recording medium, a platen 17, which is a supporting member to guide and support the backside of the recording medium, is arranged in a range between the recording position that faces the recording head 2 and a position on the downstream side in the conveying direction that is a designated distance from the recording position.

The carriage 1 enables the recording head 2 to reciprocate. For the apparatus main body 13, two guiding members, that is, one guide shaft 3 and one guide rail 4, are arranged extendedly in the direction orthogonal to the conveying direction (sheet feeding direction) of the recording medium. Then, the carriage 1 is guided and supported to be able to reciprocate along the guide members 3 and 4.

In the vicinity of both ends of the guide shaft 3, a driving pulley 18 and a driven pulley 19 are fixed, respectively. Between the pulleys 18 and 19, a timing belt 6, which is coupled with the carriage 1, is provided and tensioned by means of a tensioning spring 20. Also, a carriage motor (driving motor) 7 is connected with the driving pulley 18, and by the regular and reverse rotations of this motor 7, the carriage 1 reciprocates along the guide shaft 3 and guide rail 4.

The recovery mechanism 11 functions to prevent the clogging of the recording head 2 (particularly, clogging after recording), among other functions. The recovery mechanism 11 is provided with a capping mechanism 21, a suction pump (not shown), a wiping mechanism (not shown) and the like. The capping mechanism 21 prevents defective ink discharge of the recording head 2, and with an elastic cap member formed by rubber or the like being closely in contact with the discharge port surface 81 of the recording head 2 (to cover the discharge ports), it is arranged to prevent moisture evaporation from the discharge ports 82, among other functions.

Inside the cap of the capping mechanism 21 is connected with the suction pump (not shown) serving as negative pressure generating means through the suction tube or the like. When the suction pump is actuated while the recording head 2 is capped, inside the cap is made negatively pressurized to suck ink from the discharge ports. Then, the structure is arranged so as to exhaust overly viscous ink, dust particles, bubbles, and the like together with ink in the discharge ports, thus implementing the maintenance and recovery of the ink discharge performance of the recording head 2.

Figure 1:
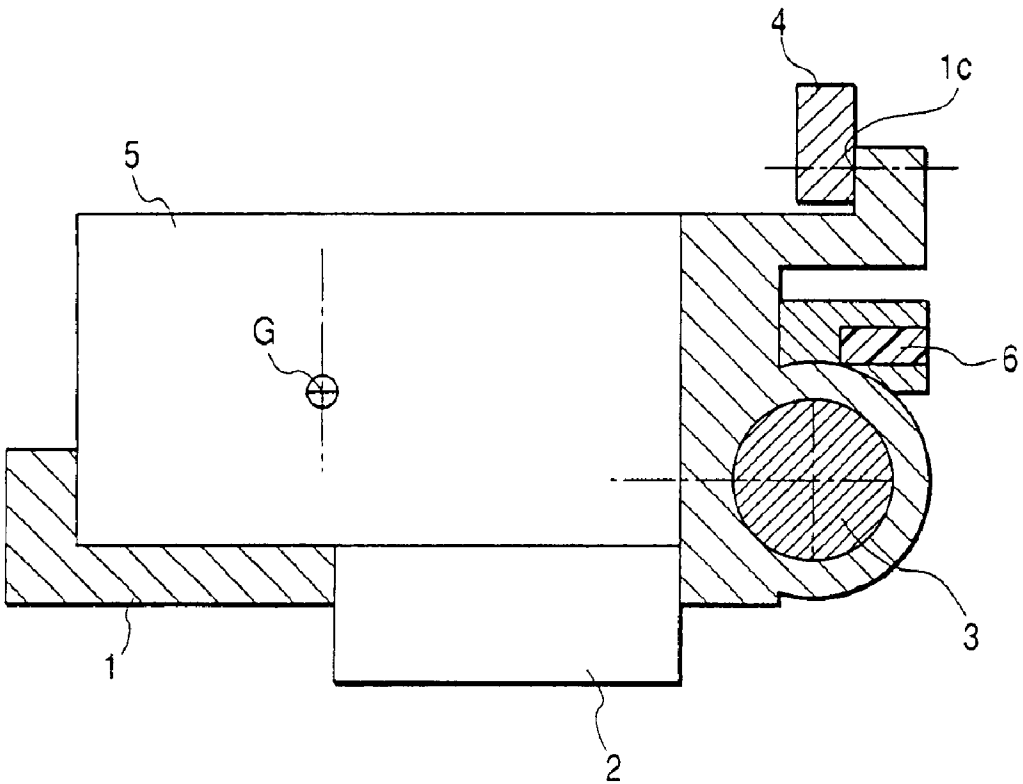
FIG. 1 is a vertically sectional view that schematically shows one embodiment of an apparatus provided with a carriage embodying the present invention.
Figure 2:
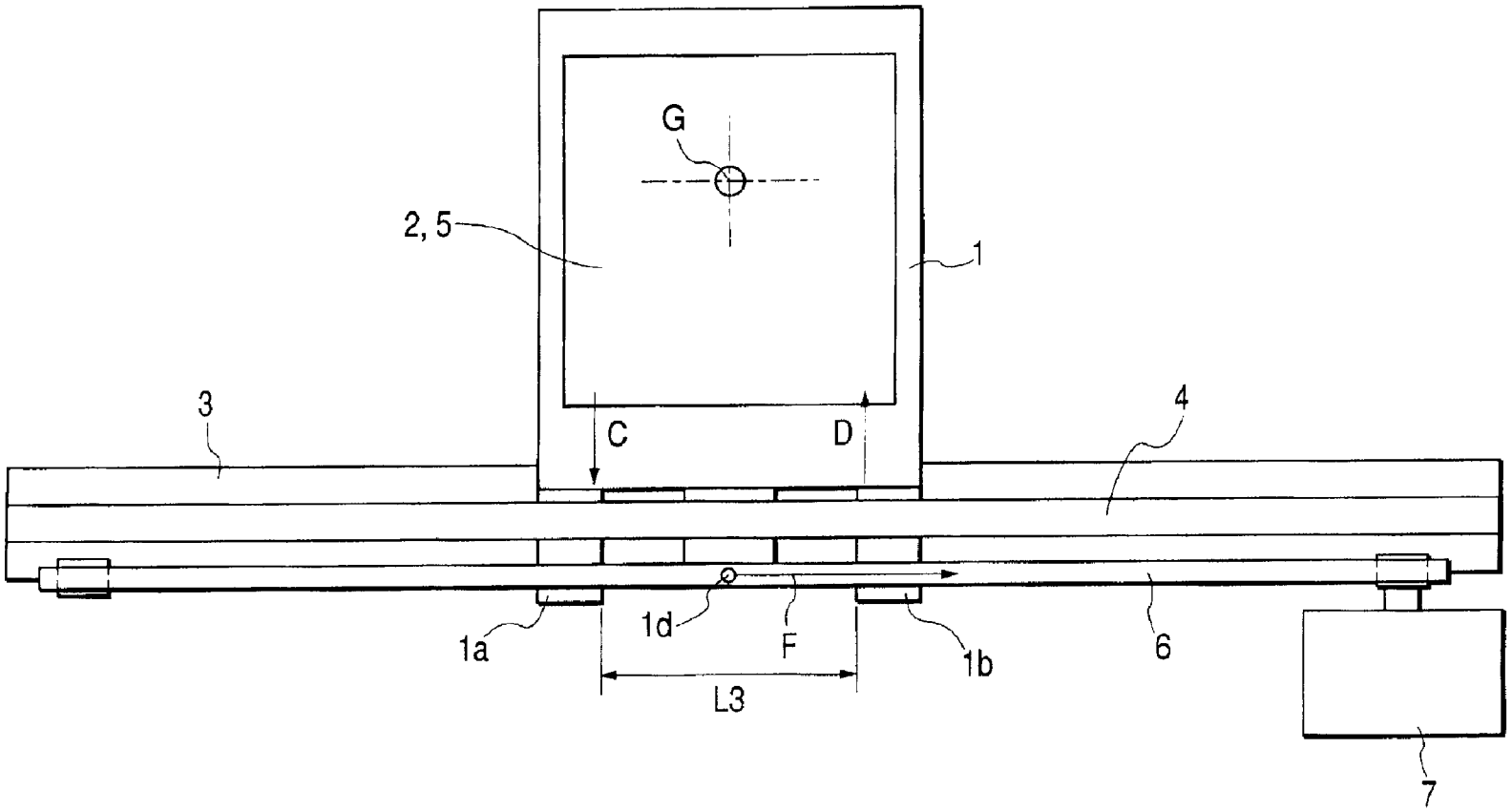
FIG. 2 is a plan view that schematically shows the apparatus provided with the carriage represented in FIG. 1.

FIG. 1 is a sectional view that schematically shows one embodiment of an apparatus provided with a carriage embodying the present invention, taken in the scanning direction thereof. FIG. 2 is a plan view that schematically shows the serial type recording apparatus represented in FIG. 1.

In FIG. 1 and FIG. 2, the recording head 2 serving as recording means is detachably mounted on the carriage 1, and the guide shaft 3 and the guide rail 4 guide the carriage 1, which is driven by the driving motor 7 through the timing belt 6 to reciprocate for scanning. Along with the reciprocal scanning of the carriage 1, the recording head 2 is driven at a designated timing in accordance with recording information for recording images on a recording medium (recording sheet or the like), which is not shown.

Also, for the present embodiment, an ink jet recording apparatus is exemplified, and in this case, the carriage 1 has an ink tank 5 mounted together with the recording head 2. Then, the structure is arranged so that ink is supplied from the ink tank 5 to the recording head 2. Here, it may be possible to integrate the ink tank 5 with the recording head 2 or to make the ink tank attachable to and detachable from the head.

In FIG. 1 and FIG. 2, the guide rail 4 is disposed almost just above the guide shaft 3, and the arrangement relationship between them is substantially perpendicular. Here, in accordance with the present embodiment, the guide rail 4 is positioned above the guide shaft 3 for the arrangement thereof, but, on the contrary, the guide shaft 3 may be disposed above the guide rail 4. In such a case, the same function and effect are equally obtainable.

For the carriage 1, there are provided bearing portions 1*a* and 1*b*, which the guide shaft 3 penetrates for fitting, and the sliding portion (guide rail contact) 1*c*, which is slidably in contact with the guide rail 4. As shown in FIG. 2, the bearing portions 1*a* and 1*b* are arranged on two locations, respectively, parting from each other in the carriage scanning direction. Then, the sliding portion 1*c* is arranged between them. Each inner diameter of the bearing portions 1*a* and 1*b*, is made larger than the outer diameter of the guide shaft approximately by 30 $\mu$m to 80 $\mu$m in order to enable them to slide smoothly on the guide shaft 3.

Also, for the present embodiment, the same molding material of the carriage 1 is used for forming the bearing portions 1*a* and 1*b*, and the sliding portion 1*c*. However, it may be possible to form only these portions with some other resin material having a good sliding capability or to make them by fixing the oil-immersed bronze member formed by the sintered material having still smaller frictional wear.

Figure 3:
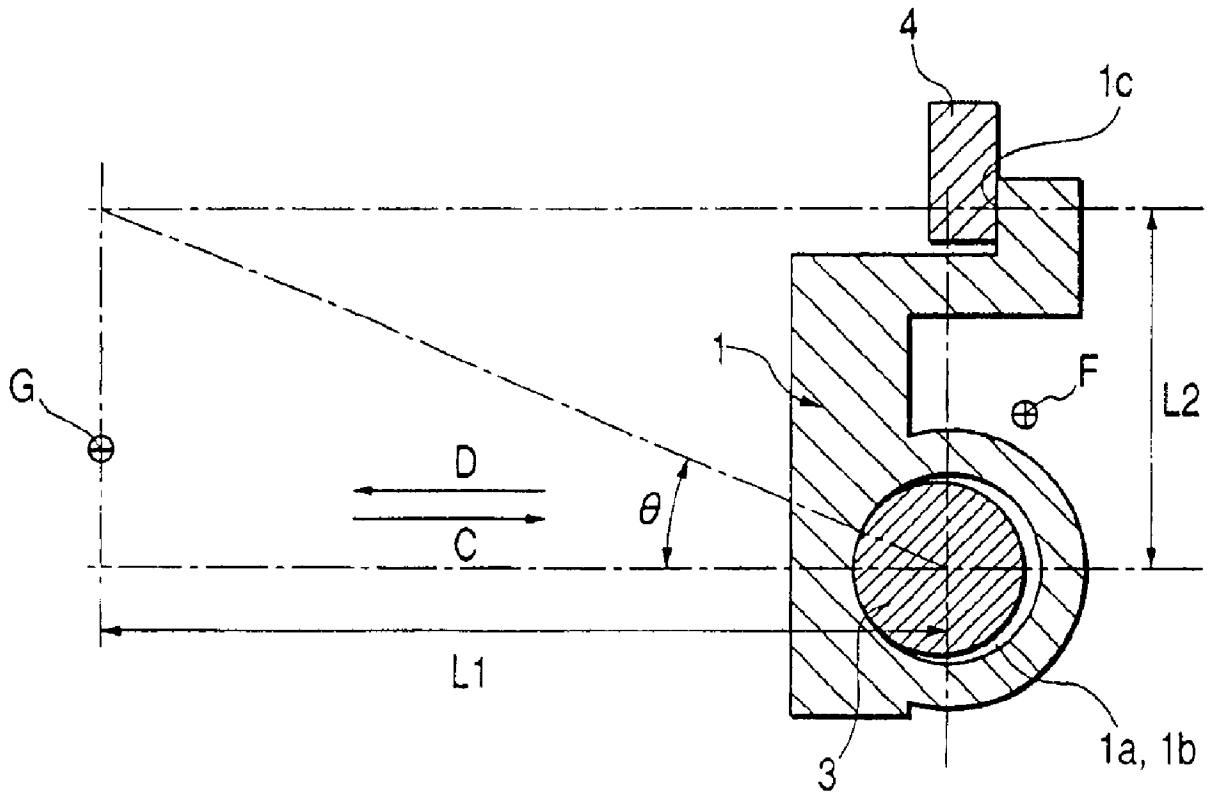
FIG. 3 is a view that schematically illustrates the force that acts upon a carriage embodying the present invention for an apparatus provided with a carriage in accordance with one embodiment of the present invention.

FIG. 3 is a cross-sectional view that shows the details of the bearing portion 1*a* of the apparatus provided with a carriage embodying the present invention. In FIG. 3, given the gravitational center of the carriage 1 having the recording head 2 and ink tank 5 mounted thereon as G, the carriage 1 tends to rotate counterclockwise centering on the guide shaft 3 in FIG. 3. Now, given the horizontal distance from the center of the guide shaft 3 to the gravitational center G as L1, and the vertical distance from the guide shaft 3 to the gravitational center of the area of the contact face 1*c* of the carriage 1 and guide rail 4 as L2, the force, which is (L1/L2) times its own weight acting upon the point G, acts on the gravitational center of the area of the contact face 1*c*. On the other hand, the guide shaft 3 and the bearing portions 1*a* and 1*b* are in contact with each portion that presents a relation of $\theta=\tan^{-1}$ (L2/L1) to the vertical axis on the inner circumferential face of the bearing as shown in FIG. 3. When the relation L2<L1 is satisfied, the contact position in the bearing portion becomes $\theta<45$ degrees. Also, the contact force exerted on the entire contact portion is $\{1+(L1/L2)^2\}^{1/2}$ times the carriage's own weight. Therefore, the contact force that acts upon one of the two symmetrical bearing portions 1*a* and 1*b*, respectively, is a half thereof. Also, if the shape of each bearing portion is different, the contact force acts upon each of them corresponding to the size of each contact portion thereof. Consequently, the greater (L1/L2), the larger becomes the pressure (contact pressure) exerted by the face.

In this respect, the L2 defines the vertical distance from the center of the guide shaft 3 to the gravitational center of the contact face 1*c* of the carriage 1 and the guide rail 4. However, if the size of the contact face 1*c* is smaller than the L2, the L2' (in FIG. 3), which is the vertical distance from the center of the guide shaft 3 to the lower end (end portion on the guide rail 4 side) of the contact face 1*c* of the carriage 1 and the guide rail 4, may be used instead of the L2.

As shown in FIG. 1 and FIG. 2, the timing belt 6 is connected with the driving power transmission portion 1*d* of the carriage 1 to transmit the driving power in the direction indicated by an arrow F (FIG. 2 and FIG. 3). In order to transmit the driving power evenly to the three sliding portions 1*a*, 1*b*, and 1*c*, the driving power transmission portion 1*d* is positioned near the sliding portion, which is within a triangle made by connecting these three points and has a higher sliding load.

While the carriage 1 comes to a stop, if the driving power is given to the driving power transmission portion 1*d*, the carriage 1 tends momentarily to rotate around the gravitational center G by means of the inertia. Therefore, as shown in FIG. 2 and FIG. 3, force acts upon each of the bearing portions 1*a* and 1*b* in the direction shown by an arrow C and arrow D, respectively. Now, given the interval between the end faces of the bearing portion 1*a* and the bearing portion 1*b*, which are opposite to each other, as L3 (FIG. 2), the force exerted on each of them is (L1/L3) times the driving power. Consequently, the larger the L3, the smaller becomes the force that causes the carriage 1 to rotate (or swing) in the horizontal direction. The influence thereof becomes smaller accordingly.

Also, the force C and the force D are those acting substantially in parallel to the horizontal surface, and if the L2 becomes smaller than the L1, the contact face of the bearing portions 1*a* and 1*b* and the guide shaft 3 is made nearer to the vertical face (that is, the portion where the tangential line is directed vertically). As a result, the directions of the force C and the force D are made nearer to the vertical direction, that is, the direction nearer to the horizontal direction. Thus, the influence that may be exerted on the carriage 1 to rotate becomes smaller.

Next, the description will be made of the balance of each force exerted on the bearing portions 1*a* and 1*b*, respectively.

As shown in FIG. 3, the force C on the bearing portion 1*a* acts on the carriage 1 to press it to the guide shaft 3. The force C acts at an angle almost perpendicular to the contact face. As a result, the component of the force is great in the direction in which both faces are pressed to be in contact. However, the component of force is small in the direction in which the carriage 1 is pushed upward. In addition to the pressure exerted by the weight of the carriage 1 itself, this force presses both faces further to be in contact, thus making the surface friction greater. Consequently, there is no possibility that sliding occurs on the contact faces of the bearing portion 1*a* and the guide shaft 3.

On the other hand, the force D on the bearing portion 1*b* acts in the direction in which the carriage 1 is drawn away from the guide shaft 3. The force D acts at an angle almost perpendicular to the contact face. As a result, the component of the force is great in the direction in which both faces are apart from each other. However, the component of force is small in the direction in which the carriage 1 slides down. At this juncture, the force that causes both faces to part is great. Therefore, if the contact force of the faces becomes negative, or even when the pressure is positive if the friction force becomes smaller by this force than the force that causes the carriage 1 to slide down, sliding occurs on the contact face of the bearing portion 1*b* and the guide shaft 3, thus causing the carriage 1 to shift downward.

However, it is possible to prevent the contact face of the bearing portion 1*b* and the guide shaft 3 from shifting by setting each of the distances L1, L2, and L3, and the driving power added at the time of acceleration of the carriage 1 appropriately, while suppressing the contact force exerted by the weight of the carriage itself strongly and the force C and force D weakly. More specifically, it is desirable to make the L2 as small as possible with respect to the L1, and make the L3 as large as possible with respect to the L1. On the other hand, however, if the structure is arranged like this, the contact force on each of the contact faces 1*a*, 1*b*, and 1*c* becomes greater to increase the amount of wear due to sliding. As a result, it is required to determine these distances in consideration of the driving power needed for the acceleration of the carriage 1, the scanning frequency of the carriage 1 with the durable time of the apparatus, and the like.

The ink tank 5 contains ink to be used for recording images. Inside the ink tank 5, it is necessary to retain ink, while keeping an appropriate negative condition, and supply it to the recording head 2. Therefore, in the ink tank 5, there is provided some means for generating negative pressure, besides ink.

Figure 4B:
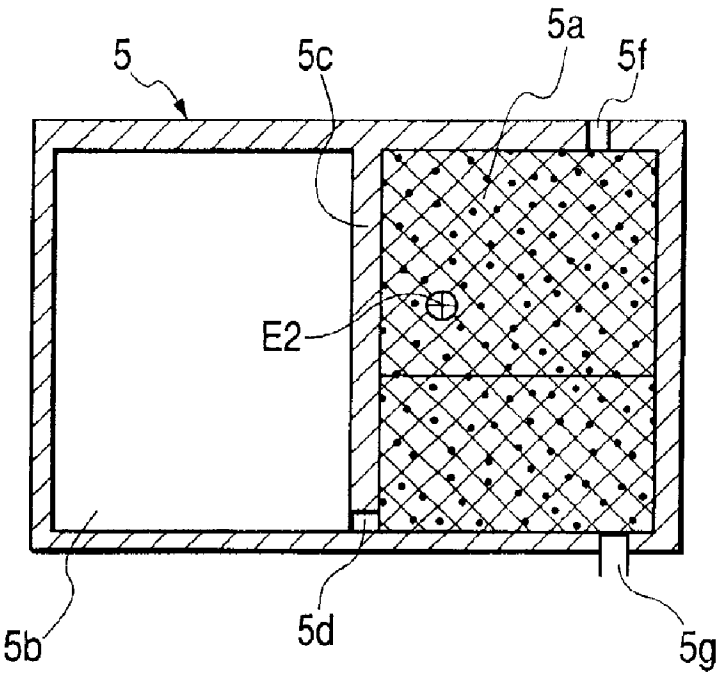
FIG. 4B is a view that schematically shows the inner structure of one example of the ink tank used for an ink jet head in a state of retaining a small amount of ink.
Figure 4A:
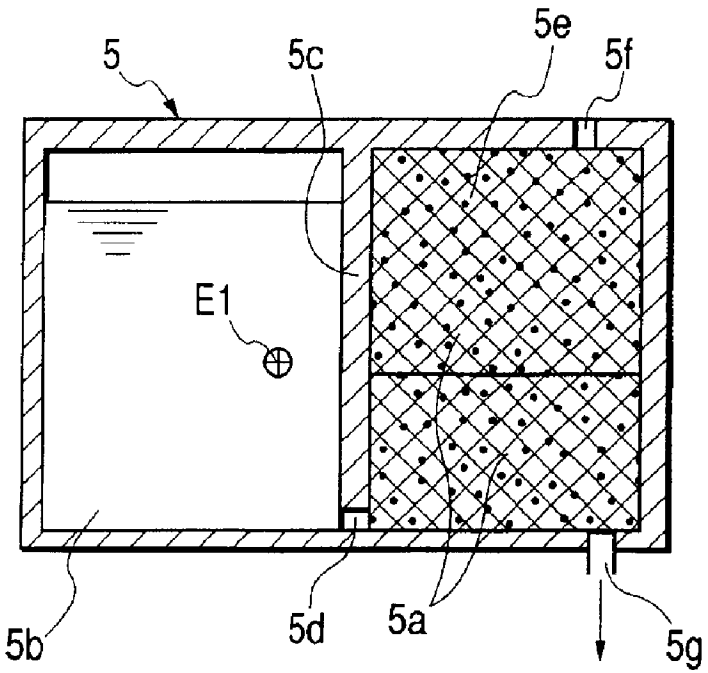
FIG. 4A is a view that schematically shows the inner structure of one example of the ink tank used for an ink jet head in a state of retaining a large amount of ink.

FIGS. 4A and 4B are vertically sectional views that illustrate one example of the ink tank 5 of an ink jet recording apparatus provided with a carriage embodying the present invention. FIG. 4A shows the state where a large amount of ink is retained in the ink tank. FIG. 4B shows the state where a small amount of ink is retained in the ink tank.

In FIGS. 4A and 4B, the ink tank 5 is provided with an ink absorbent holding chamber 5*a* that generates negative pressure by retaining ink in the ink absorbent, such as a sponge, and a fresh ink retaining chamber 5*b* that retains liquid ink as it is.

The ink absorbent holding chamber 5*a* and the fresh ink retaining chamber 5*b* are formed by partitioning the interior of the ink tank 5 with partitioning portion 5*c*. On the lower end of the partitioning portion 5*c*, a communication hole 5*d* is formed to enable both chambers 5*a* and 5*b* to be communicated. Inside the ink absorbent holding chamber 5*a*, an ink absorbent 5*e* is filled, and an atmospheric communication port 5*f* is formed on the upper face of the ink absorbent holding chamber 5*a*. Ink contained in the ink tank 5 is supplied to the recording head 2 through a supply port 5*g* provided for the bottom portion on the ink absorbent holding chamber 5*a* side.

A point E1 shown in FIG. 4A represents the gravitationally central position of the ink tank when a large amount of ink is retained in the ink tank 5. A point E2 shown in FIG.

4B shows the gravitationally central position of the ink tank when a small amount of ink is retained in the ink tank 5.

As indicated by the points E1 and E2, the gravitationally central position differs depending on the amount of ink retained in the ink tank 5. If an ink tank 5 of the kind is mounted on the carriage 1, the gravitationally central position of the carriage 1 as a whole shifts accordingly depending on the amount of ink retained in the ink tank 5. Therefore, it is required to determine each position and distance of the respective portions so that when the gravitationally central position of the ink tank 5 is brought nearest to the guide shaft 3, that is, even when the distance L1 in FIG. 3 becomes smallest, the relationship of L2<L1 is satisfied, and at the same time, when the gravitationally central position of the ink tank 5 becomes farthest from the guide shaft 3, that is, even when the L1 becomes largest, the relationship of L1<L3 is satisfied.

For the present embodiment, the description has been made of an ink tank formed by an ink absorbent holding chamber 5*a* and a fresh ink retaining chamber 5*b*. Here, it is required to give the same consideration to an ink tank 5 that generates negative pressure by means of some other mechanism. Also, for the present embodiment, the description has been made of an ink jet recording apparatus that records images by means of ink jet recording, but the present invention is equally applicable to a recording apparatus that records images by some other means, and the same effect is attainable. Further, the present invention is not necessarily limited to a recording apparatus. The invention is widely applicable to any other apparatus if only the apparatus is such that various functions are performed by carriage scanning, such as an image reading apparatus that mounts a reading head on a carriage 1.

In accordance with the embodiment described above, an apparatus comprises a carriage 1; guide members 3 and 4 that guide the carriage 1 in the main scanning direction; and driving means 6 and 7 that drive the carriage 1. Then, the carriage 1 comprises contact portions 1*a*, 1*b*, and 1*c* with which each of the guide members 3 and 4 is slidably in contact, respectively, and each of the guide members 3 and 4 is arranged in parallel to each other, apart from each other substantially in vertical direction, and the distance L1 between each of the guide members 3 and 4, and the gravitational center (point G) of the carriage 1 in the horizontal direction is made larger than the distance L2 between the contact portions themselves in the vertical direction.

Also, in accordance with the embodiment described earlier, at least one of the guide members 3 and 4 is a guiding shaft having a circular section, and driving means 6 and 7 are connected with the carriage 1 in the vicinity of the guide shaft 3. Then, the distance L1 from the center of the guide shaft 3 to the gravitational center G of the carriage 1 in the horizontal direction is arranged to be larger than the distance L2 from the center of the guide shaft to the contact portion 1*c* of the other guide member 4 and the carriage 1 in the vertical direction.

Further, in accordance with the embodiment described earlier, at least one of the guide members 3 and 4 is a flat plate type guide rail 4, and the distance L1 from the center of the guide shaft 3 to the gravitational center G of the carriage 1 in the horizontal direction is arranged to be larger than the distance L2 from the center of the guide shaft 3 to the sliding portion 1*c* of the guide rail 4 provided for the carriage.

Also, in accordance with the embodiment described earlier, the contact portion of the guide shaft 3 and the carriage 1 is formed by each of the bearing portions 1*a* and 1*b*, each which has the inner diameter of the cylindrical inner wall larger than the outer diameter of the guide shaft, and each of the bearing portions 1*a* and 1*b* is arranged at least at two location apart from each other in the scanning direction of the carriage, respectively. The distance L1 from the center of the guide shaft 3 to the gravitational center G of the carriage is arranged to be smaller than the distance L3 between the end faces of the adjacent bearing portions 1*a* and 1*b*, which face each other.

Also, as described earlier, the resin that is the structural material of the carriage 1 may be used for the simultaneous formation of the bearing portions 1*a* and 1*b* or the structure may be arranged so that the resin, the composition of which differs from the structural material of the carriage 1, is used for the purpose.

Further, as described earlier, the bearing portions 1*a* and 1*b* may be formed with oil-immersed bronze.

Also, the resin structural material of the carriage 1 may be used for the simultaneous formation of the sliding portion 1*c* of the carriage 1 and the guide rail 4 or the resin having different composition from that of the structural material of the carriage 1 may be used for the formation thereof.

Further, the sliding portion 1*c* of the carriage and the guide rail may be formed with oil-immersed bronze, too.

In this respect, for the embodiment described above, the description has been made of the case as an example where the apparatus provided with a carriage is an ink jet recording apparatus. However, in a case of the present invention being applied to a serial type recording apparatus, there may be the recording apparatus such as the wire-dot type that uses ink ribbon or the like, the thermo-sensitive type, the laser beam type, besides the one that uses liquid ink, and the invention is equally applicable to them, and the same functional effect is attainable.

Also, the present invention is equally applicable to the recording apparatus that performs monochromatic recording, the color recording apparatus that uses one or more recording heads for a plurality of different colors, the gradation recording apparatus that uses a single color but records in different densities, and further, the recording apparatus having them combined, or the like, and the same effect is attainable.

Also, when the present invention is applied to the ink jet recording apparatus that records using liquid ink, it is equally applicable to the one structured to use the exchangeable head cartridge, for which the recording head and ink tank are formed, and the same effect is obtainable.

Further, when the present invention is applied to an ink jet recording apparatus, it is equally applicable to the one that adopts recording means using an electro-mechanical converting element, such as a piezoelectric element. Particularly, however, it can obtain excellent effects when the invention is applied to the ink jet recording apparatus using recording means of the ink discharging type that utilizes thermal energy, because with this type, recording is possible in high density and high precision.

As is clear from the above description, in accordance with the present embodiment, it is possible to effect reciprocal scanning exactly and stably by reducing the swinging or vibration of the carriage to be guided for the provision of an apparatus provided with a carriage capable of highly precise scanning stably, which is needed for various kinds of small, high-performance apparatuses, such as the recording apparatus that performs image recording in high precision and the reading apparatus that reads images of high density and high precision.

What is claimed is:

1. An apparatus provided with a carriage for mounting a head member for the reciprocation thereof, said apparatus comprising:

a guide shaft for supporting and guiding said carriage;

a timing belt for transmitting a driving force of a driving motor to said carriage;

a guide member provided on a side of said guide shaft to which said timing belt is opposed, and provided parallel to and substantially vertically above said guide shaft to support and guide said carriage; and a contact portion provided on said carriage to slidably contact said guide member, wherein a horizontal distance between a center of said guide shaft and a center of gravity of said carriage mounting a head member is greater than vertical distance between the center of said guide shaft and said contact portion.

2. An apparatus according to claim 1, wherein said timing belt is connected with said carriage in the vicinity of said guide shaft.

3. An apparatus according to claim 1, wherein said guide member comprises a flat plate-type guide rail.

4. An apparatus according to claim 3, wherein said contact portion of said carriage is formed simultaneously with said carriage by a resin used as the structural material of said carriage.

5. An apparatus according to claim 3, wherein said contact portion of said carriage is formed by a resin having a different composition from the structural material of said carriage.

6. An apparatus according to claim 3, wherein said contact portion of said carriage and said guide rail are formed by oil-immersed bronze.

7. An apparatus according to claim 1, wherein said carriage is provided with a plurality of bearing portions fitting with said guide shaft and being apart in a scanning direction of said carriage, and wherein the distance from the center of said guide shaft to the gravitational center of said carriage is smaller than an interval between end faces of said bearing portions facing each other.

8. An apparatus according to claim 7, wherein said bearing portions are formed simultaneously with said carriage by resin used as the structural material of said carriage.

9. An apparatus according to claim 7, wherein said bearing portions are formed by resin having a different composition from the structural material of said carriage.

10. An apparatus according to claim 7, wherein said bearing portions are formed by oil-immersed bronze.

11. An apparatus according to claim 1, wherein said head member comprises a recording head for recording on a recording medium, and is serially reciprocated by said carriage.

12. An apparatus according to claim 11, wherein said recording head is an ink jet recording head for recording by discharging ink onto the recording medium.

13. An apparatus according to claim 12, wherein an ink tank is mounted on said carriage to supply ink to the recording head, and when the amount of ink retained in the ink tank changes by recording operation, the position of the gravitational center of said carriage changes.

14. An apparatus according to claim 12, wherein said ink jet recording head is provided with an electrothermal converting element for generating thermal energy to be utilized for discharging ink.

15. An apparatus according to claim 1, wherein said head member comprises a reading head for reading a source document, and is serially reciprocated by said carriage.

* * * * *

UNITED STATES PATENT AND TRADEMARK OFFICE

CERTIFICATE OF CORRECTION

PATENT NO. : 6,932,457 B2
APPLICATION NO. : 10/093743
DATED : August 23,2005
INVENTOR(S) : Sato It is certified that error appears in the above-identified patent and that said Letters Patent is hereby corrected as shown below:

ON THE TITLE PAGE

Item (56), Foreign Patent Documents, "05116338" should read --5-116338--; "08090782" should read --8-90782-- and "2001219568" should read --2001-219568--.

Column 5

Line 60, "Inside" should read --The interior of--.
Line 64, "inside" should read --the interior of--.

Column 8

Line 37, "negative" should read --negative-pressure--.

Column 10

Line 2, "each" should read --each of--.
Line 5, "location" should read --locations--.

Column 11

Line 17, "than" should read --than a--.

Signed and Sealed this

Nineteenth Day of September, 2006

JON W. DUDAS
*Director of the United States Patent and Trademark Office*